United States Patent [19]

Fortune

[11] Patent Number: 4,476,596

[45] Date of Patent: Oct. 16, 1984

[54] COMBINATION TIP WRENCH AND STAND

[76] Inventor: William S. Fortune, 29866 Cuthbert St., Malibu, Calif. 90265

[21] Appl. No.: 310,945

[22] Filed: Oct. 13, 1981

[51] Int. Cl.[3] ..... B25F 1/00

[52] U.S. Cl. ..... 7/138

[58] Field of Search ..... 81/119, 121 A, 180 R, 81/125.1; 7/138

[56] References Cited

U.S. PATENT DOCUMENTS

| | | | |
|---|---|---|---|
| 172,277 | 1/1876 | Norris | 81/125.1 |
| 1,131,035 | 3/1915 | Brown | 81/119 |
| 1,424,676 | 8/1922 | Parsons | 81/125.1 |
| 1,855,586 | 4/1932 | Nordstrom | 81/119 X |

*Primary Examiner*—James G. Smith

*Attorney, Agent, or Firm*—Daniel T. Anderson

[57] ABSTRACT

A combination tip wrench and stand which is particularly designed for use with a soldering or desoldering instrument, but having other uses. Basically the tip wrench is of generally U-shape, consisting of a top wall and two side walls, preferably of sheet metal. The instrument has a first, a second, and a third width of successively smaller dimensions, the largest width being at one end. The top wall extends only from the second width and is provided with a first U-shaped opening. The other end also has a second U-shaped opening in the top wall, thus forming a first, a second, and a third wrench. Near the third U-shaped opening is a portion normal to the top wall and the side walls and integral therewith and having a circular opening to extend, for example, a soldering tip therethrough, while its nut can be unscrewed by engagement with the side walls. The instrument also includes a pair of legs which in their folded position extend over the smallest width of the tip wrench. The two legs are yieldably held by a tension spring extending through apertures in the side walls. The ends of the legs near the spring include a portion normal to the legs, so shaped as to lock the legs against the side walls and also, in the extended position, to lock the legs against the width of the side walls, thereby to form a stand for an instrument.

3 Claims, 13 Drawing Figures

Fig. 1.
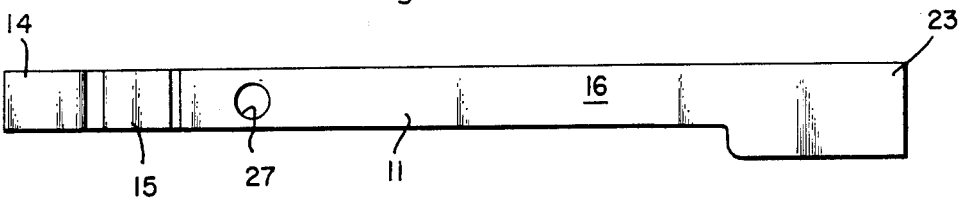
Fig. 2.
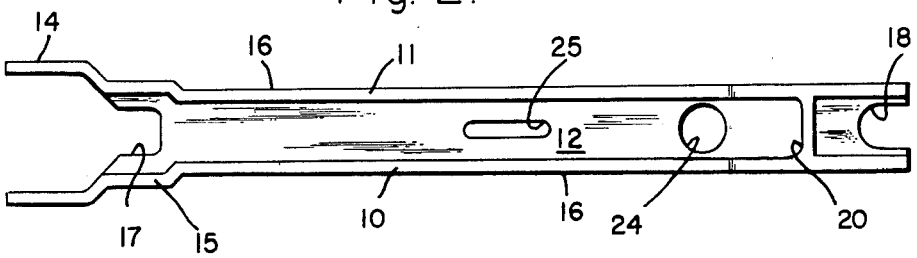
Fig. 4.
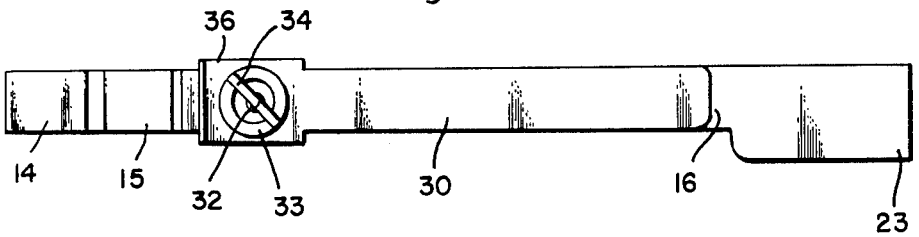
Fig. 5.
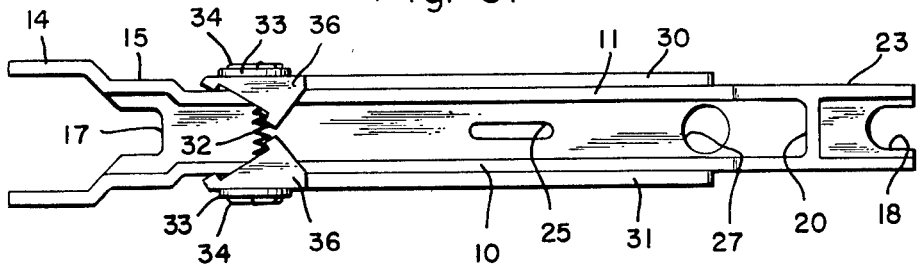
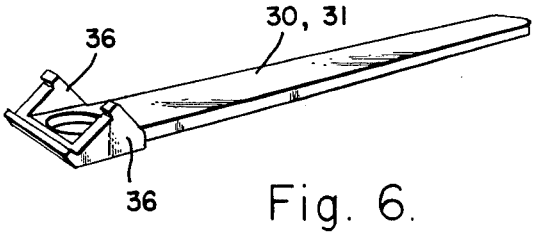
Fig. 6.
Fig. 3.
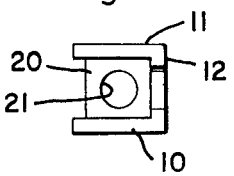

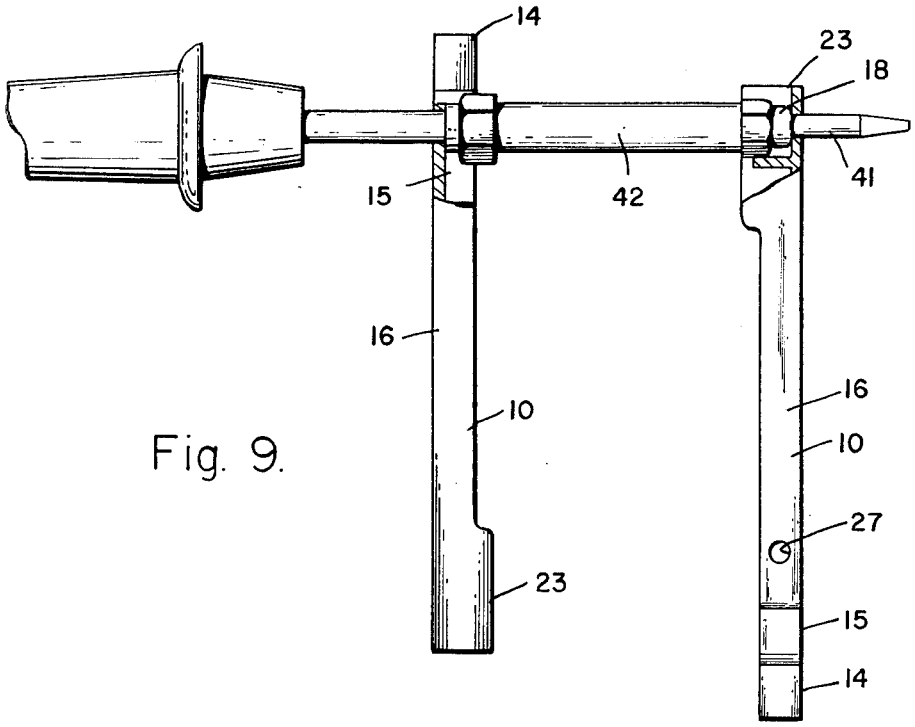
Fig. 9.
Fig. 10.
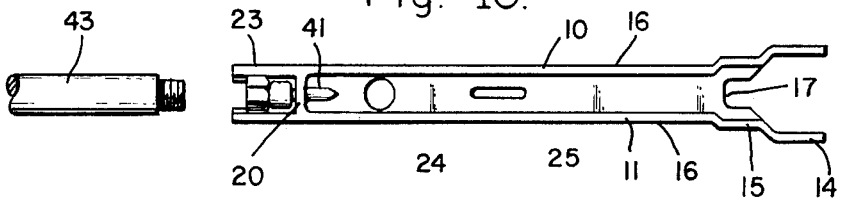
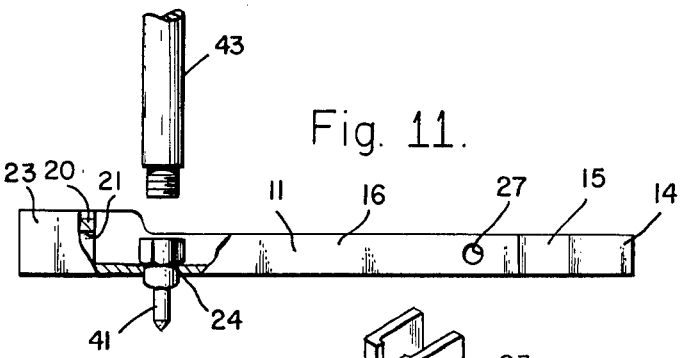
Fig. 11.
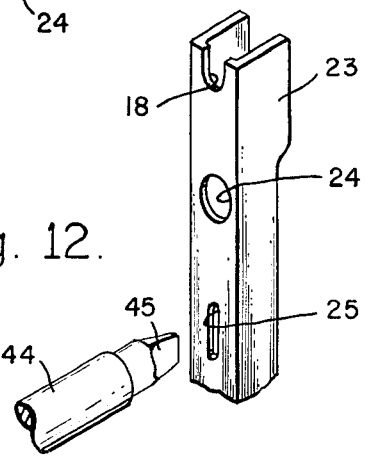
Fig. 12.

COMBINATION TIP WRENCH AND STAND

BACKGROUND OF THE INVENTION

This invention relates generally to a combination wrench and particularly to a wrench suitable for use with a soldering or desoldering instrument and including a stand for such an instrument.

It is particularly desirable to tighten or loosen the nuts on a soldering instrument of the type disclosed and claimed in the applicant's prior patents, U.S. Pat. Nos. 3,883,716 and 4,055,744. Thus, by tightening or loosening the nuts on these instruments, the soldering tips may be adjusted or removed and like operations performed. Also, since the tip is preferably electrically heated, it may get very hot, and provision should be made that the tip does not fall on a work bench, or into parts to be worked upon.

Furthermore, it is desirable that such a wrench is capable of tightening or loosening nuts of different sizes. On the other hand, it is desirable that such a wrench be small and easily carried by hand or in a tool box.

SUMMARY OF THE INVENTION

Thus, in accordance with the present invention, there is provided a wrench consisting basically of a U-shaped member, preferably of sheet metal, having a top wall and two side walls. The side walls define three regions of different widths; a first and largest region being at one end, followed by a second region of smaller width and finally a third region extending over the remainder of the instrument, of the smallest width. The top wall extends only through the second region, so that the first region forms a conventional wrench.

The top wall of the second region is provided with a U-shaped opening. Accordingly, a second wrench is formed for holding a nut by the width of the side walls, while the remainder of the instrument may extend through the U-shaped opening.

The other end of the instrument is also provided with a U-shaped opening to form a third wrench which operates somewhat like the second one. An additional wrench is formed by a portion near the other end of the instrument and normal to the top and side walls. This portion is provided with a circular opening for extending therethrough, for example, a soldering tip, while the side walls form a wrench to remove the tip while the hot tip is retained in the instrument.

Finally, the stand is provided with a pair of spring-biased legs which, in their folded position, extend along the outside walls of the side walls of the third, or narrowest, width thereof. Each end of the legs has an extension disposed normal to the leg, for retaining the legs in their folded position and for retaining the legs within the width of the side walls and normal thereto, to provide a stand.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

BRIEF DESCRIPTION OF THE DRAWINGS

FIG. 1 is a side elevational view of a tip wrench embodying the present invention but without the legs forming a stand;

FIG. 2 is a bottom plan view of the tip wrench of FIG. 1;

FIG. 3 is an end view illustrating an apertured portion disposed normal to the top and side walls;

FIG. 4 is a side elevational view similar to that of FIG. 1 but illustrating one of the rotatable legs providing a stand;

FIG. 5 is a bottom plan view of the tip wrench and stand of FIG. 4, showing the legs, the spring biasing the legs and a pair of triangular portions for locking the legs in both their folded and unfolded, or extended positions;

FIG. 6 is a view taken in perspective of one of the two legs of FIG. 5;

FIG. 9 is a side elevational view of two tip wrenches without legs, showing their application for loosening or removing the nut of the heating element, as well as the nut of the soldering tip, the latter being accomplished by a second instrument shown in side elevation and utilizing the third wrench;

FIG. 10 is a bottom plan view of the wrench of FIGS. 1 and 2, and illustrating how the fourth wrench may be utilized to remove a hot soldering tip from the heating element, shown spaced from the tip;

FIG. 11 is a side elevational view illustrating another way of removing a hot soldering tip having a different size from the heating element, shown separated, while retaining the soldering tip;

FIG. 12 is a partial bottom view in perspective of the tip wrench of FIGS. 1 and 2, illustrating its application for either locking or aligning a spade tip.

DESCRIPTION OF THE PREFERRED EMBODIMENT

Figure 7:
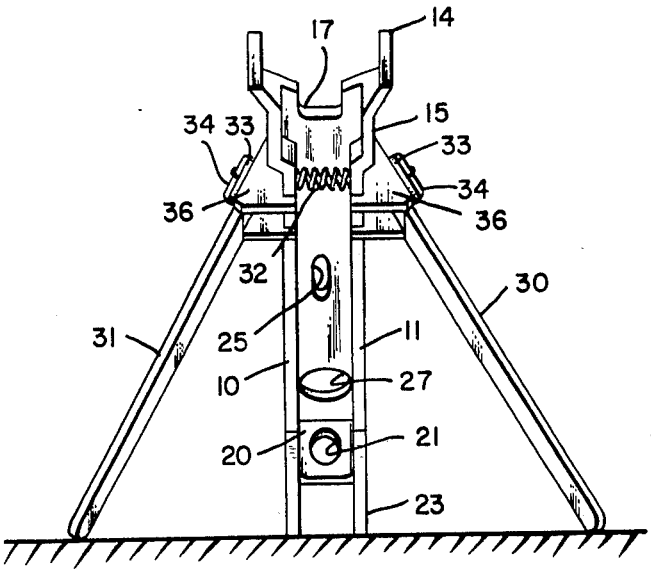
FIG. 7 is an end view showing the legs in the unfolded or extended position and the tip wrench.

Referring now to the drawings, and particularly to FIGS. 1 through 3, there is illustrated the combination tip wrench of the invention, without the provision of a pair of legs forming it into a stand. The wrench includes two side walls 10 and 11, and a top wall 12. Preferably side walls 10 and 11 and top wall 12 consist of sheet metal such, for example, as cold rolled steel or aluminum of uniform thickness. The side walls 10 and 11 define three portions of different widths; that is, a first portion 14 near one end which has the greatest width, a second portion 15 of intermediate width and a third and longest portion 16 of the smallest width. These different widths form three different wrenches for different sizes of nuts. It will be understood that the nuts may be fixed to, or integral with, a retaining sleeve or the like. As is clearly shown in FIG. 2, the top wall 12 does not extend through the largest width 14. It is provided with a U-shaped cutout or aperture 17 extending through a portion of the second width 15. The third width 16 is also provided with a U-shaped aperture 18 in the other end, thus forming a third wrench.

As clearly shown in FIG. 3, a connecting portion 20 is normal to the two side walls 10, 11 and the top wall 12 and is provided with a circular aperture 21. It is positioned somewhat rearwardly of the U-shaped aperture 18. As clearly shown in FIG. 1, the two side walls 10, 11 have an increased height 23 in the area surrounding the U-shaped aperture 18 and the interconnecting portion 20.

The top wall 12 may also be provided with a circular opening 24 somewhat rearwardly of the portion 20. Its purpose is to pass a soldering tip therethrough, while its nut may be tightened or loosened by the two side walls 10 and 11. Circular opening 24 preferably has a larger diameter than that of circular opening 21. Thus, soldering tips of different diameters may be passed either through opening 21 or through opening 24.

Somewhat in the middle of the top wall 12 there may be provided an elongated oval opening 25. It may, for example, serve the purpose to line up, tighten or loosen a space tip such as shown in applicant's prior U.S. Pat. No. 4,055,744.

Finally, the two side walls 10 and 11 are provided with a small hole 27 disposed adjacent the second width 15 in the third width 16. The purpose of the hole 27 will now be described.

Referring now to FIGS. 4 through 7, there are shown two legs 30 and 31 which, in their folded position as shown in FIGS. 4 and 5, extend over the third width 16. A tension spring 32 extends through the holes 27 in the side walls 10, 11 and may be secured respectively to the two legs, for example, by a circular disk 33 having a rod or bar 34 thereacross, to which one end of the spring is secured.

Each of the legs 30 and 31 is provided, on both sides, with a downwardly extending triangular portion 36; that is, the portion 36 is normal to the associated leg 30 or 31. Each of the triangular portions is formed with a small square recess 37 at one face, of a width to fit exactly over one of the side walls 10 or 11, as clearly shown in FIGS. 5 to 7. Also, the two triangular portions 36 of each leg are so spaced (see FIG. 4) that they will fit snugly over the width of each of the side walls.

Hence, it is now possible to lift each leg against the action of spring 32 until its triangular portions 36 clear the side wall and until the rectangular recess 37 fits snugly over the width of each side wall. The legs will now extend normal to the side walls 10, 11, as clearly shown in FIG. 6, to form a stand for an instrument which may be received, for example, by the first wrench 14. The angle of the triangular portions 36 determines the angle the legs 30 form with side walls 10, 11, as illustrated in FIG. 7.

Figure 8:
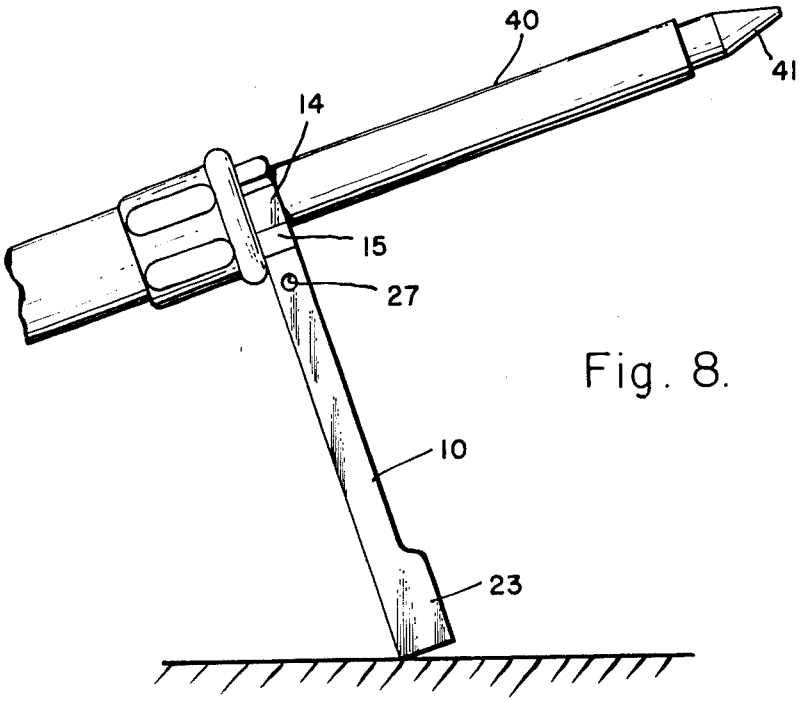
FIG. 8 is a side elevational view of the tip wrench of FIG. 1, but without the legs and in position to unscrew the heater element and tip of a soldering instrument, to illustrate the operation of the first wrench.

The remaining FIGS., 8 through 13, show how each of the wrenches may be used, or how the stand may be utilized. FIG. 8 illustrates how a temperature-controlled soldering instrument of the general type shown in applicant's prior U.S. Pat. No. 3,883,716 may have its heater sleeve removed by the tip wrench of the present invention. Thus, the greatest width 14 of the instrument may be pushed over the nut of a soldering instrument to remove the heater sleeve 40 and tip 41.

FIG. 9 illustrates how two wrenches of the type described herein may be used to tighten or remove simultaneously the soldering tip 41 from the heater sleeve 42, and the heater sleeve 42 from a soldering instrument. Thus, the second width 15 of the first wrench, shown to the left, may engage the nut of the heater sleeve 42, while the second wrench, shown to the right, engages the nut of the soldering tip 41 with its rear portion, the tip extending through the U-shaped opening 18. It will, of course, be realized that the side walls 10 and 11 form the wrench which engages the respective nuts.

FIG. 10, to which reference is how made, illustrates how a hot soldering tip 41 may be removed from the heater element 43. This is effected by the portion 20, through the opening 21 of which extends the soldering tip. Again, the side walls of the instrument engage the nut. The hot soldering tip 41 is retained by the instrument of the invention.

Similarly, FIG. 11 illustrates how the same purpose may be obtained by extending the soldering tip 41 through the circular opening 24 of the soldering instrument. The soldering tip 41 is retained by the opening 24, while the heater element 43 may be removed. It is to be noted again that the two circular openings 21 and 24 of different diameters allow soldering tips of different sizes to pass therethrough.

FIG. 12 illustrates a use of the elongated oval opening 25 in the top wall 12. Here a soldering tip 44 is shown with a spade-like end 45. The end may be extended through the oval opening 25, which permits to rotate the heater sleeve 43 to adjust the position of the spade tip, or to tighten it.

Figure 13:
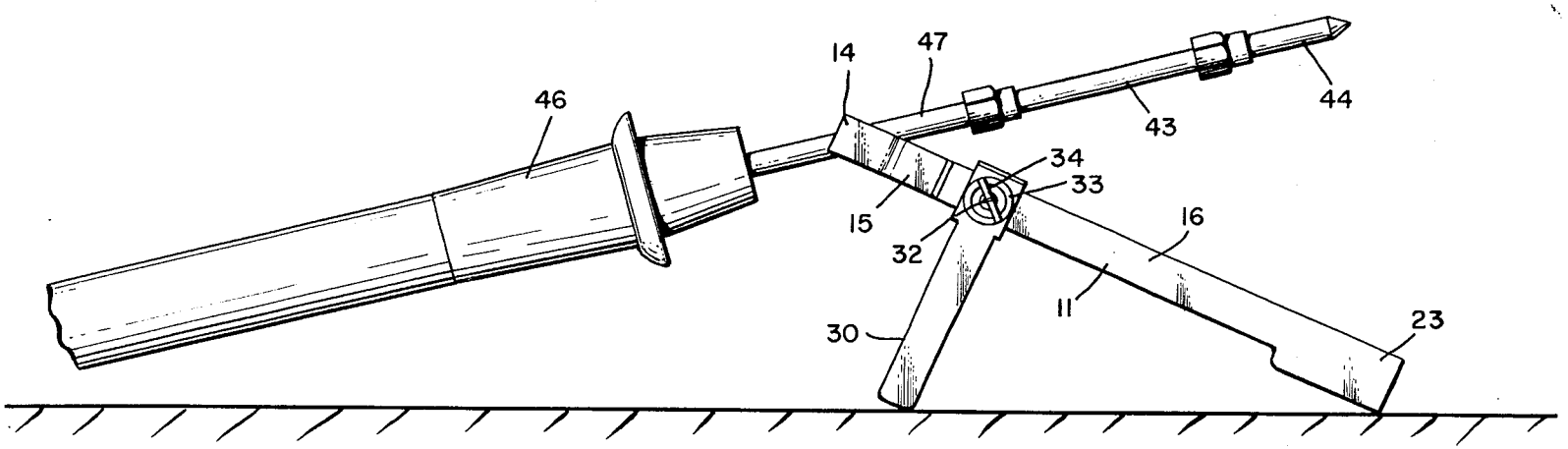
FIG. 13 is a side elevational view of the tip wrench and stand of FIGS. 4 through 7 and illustrating its use as a stand for a soldering instrument.

Finally, FIG. 13 shows the instrument with its legs 30 and 31 in the extended position to support a soldering instrument 46 by the widest portion 14 and preferably by its extension sleeve 47.

There has thus been disclosed a combination tip wrench and stand. The combination tip wrench includes six different wrenches disposed in the same U-shaped member. This permits to remove, for example, soldering tips and the like, or to tighten them. Alternatively, such elements may be adjusted or positioned. A pair of legs are provided which, in their folded position, are locked to the outside surfaces of the side walls of the instrument. Against the tension of a spring, they may be lifted and rotated into an extended position, where again they are locked to the width of the side walls to provide a safe stand for a soldering instrument or the like.

I claim:

1. A combination tip wrench comprising:

(a) a generally U-shaped metallic member having a top wall and two side walls, said side walls defining from one end thereof a first, a second, and a third width of successively smaller dimensions, the largest width being at said one end;

(b) said top wall extending only from said second width to the other end of said member, whereby said first width forms a first wrench, said top wall forming a first U-shaped opening substantially coincident with said second width, and said third width extending from said other end of said top wall;

(c) a portion extending substantially normal from said top wall and connecting said side walls, said portion being disposed adjacent said second U-shaped opening in said top wall, said portion having a third circular opening therethfough substantially midway of said portion, whereby said second width and first U-shaped opening form a second wrench, and said second opening and third width form a third wrench and said circular opening and third width form a forth wrench; and (d) a stand including a pair of legs, each leg, when folded, extending along the outer surface of one of said side walls and within said third width, spring means for retaining said legs in their folded position and permitting them to be rotated into an extending position substantially normal to said side walls, and means to the ends of said legs adjacent said side walls in the folded position for releasably retaining said legs in the extended position.

2. A tip wrench as defined in claim 1 wherein said spring means includes a tension spring, said tension spring extending normal to said side walls and through holes in said side walls substantially adjacent said second width and through apertures in said ends of said legs, and an element for retaining each end of said spring through said apertures in said legs to said legs.

3. A tip wrench as defined in claim 2 wherein said means includes a substantially triangular portion integral with its associated leg and substantially normal thereto, and provided at said end of each of said legs on both sides thereof, each of said triangular portions having an outer recessed portion to fit exactly over the associated side wall, to retain said legs in the extended position, said triangular portions forming such an angle with its associated leg to position the leg at a desired angle to the associated outer surface in the extended position, and said triangular portions retaining said legs in the folded position.

* * * * *